United States Patent [19]

Gibson

[11] 4,099,341

[45] Jul. 11, 1978

[54] FOOT WARMER

[76] Inventor: Larry R. Gibson, Rte. 6, Box 652, Easley, S.C. 29640

[21] Appl. No.: 725,691

[22] Filed: Sep. 23, 1976

Related U.S. Application Data

[63] Continuation-in-part of Ser. No. 648,115, Jan. 12, 1976, abandoned.

[51] Int. Cl.[2] ..... A43B 1/10; A43B 5/04

[52] U.S. Cl. ..... 36/7.3; 36/120

[58] Field of Search ..... 36/7.1, 7.3, 117, 120, 36/121, 87, 4, 2.6

[56] References Cited

U.S. PATENT DOCUMENTS

| | | | |
|---|---|---|---|
| 1,746,459 | 2/1930 | Brady | 36/7.1 R |
| 3,691,658 | 9/1972 | DiPerno et al. | 36/4 |
| 3,820,256 | 6/1974 | Schoch | 36/120 |
| 3,868,783 | 3/1975 | Caporicci | 36/120 |

*Primary Examiner*—Patrick D. Lawson

*Attorney, Agent, or Firm*—Bailey, Dority & Flint

[57] ABSTRACT

A foot warmer constructed of a stiff insulating foam material such as polystyrene, is illustrated having a displaceable front end panel providing an opening when displaced for receiving a wearer's shoe, boot, and the like enabling the foot warmer to be readily placed upon the foot and the front end panel replaced to thus provide a foot warmer wherein insulation extends about the leg of the wearer at least as far up as the area of the ankle to provide an effective foot warmer.

7 Claims, 7 Drawing Figures

Fig. 4.
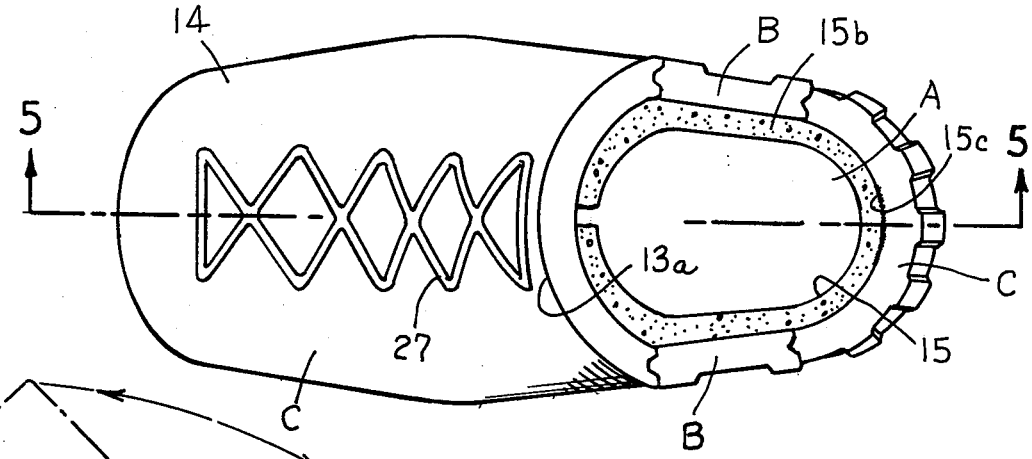
Fig. 6.
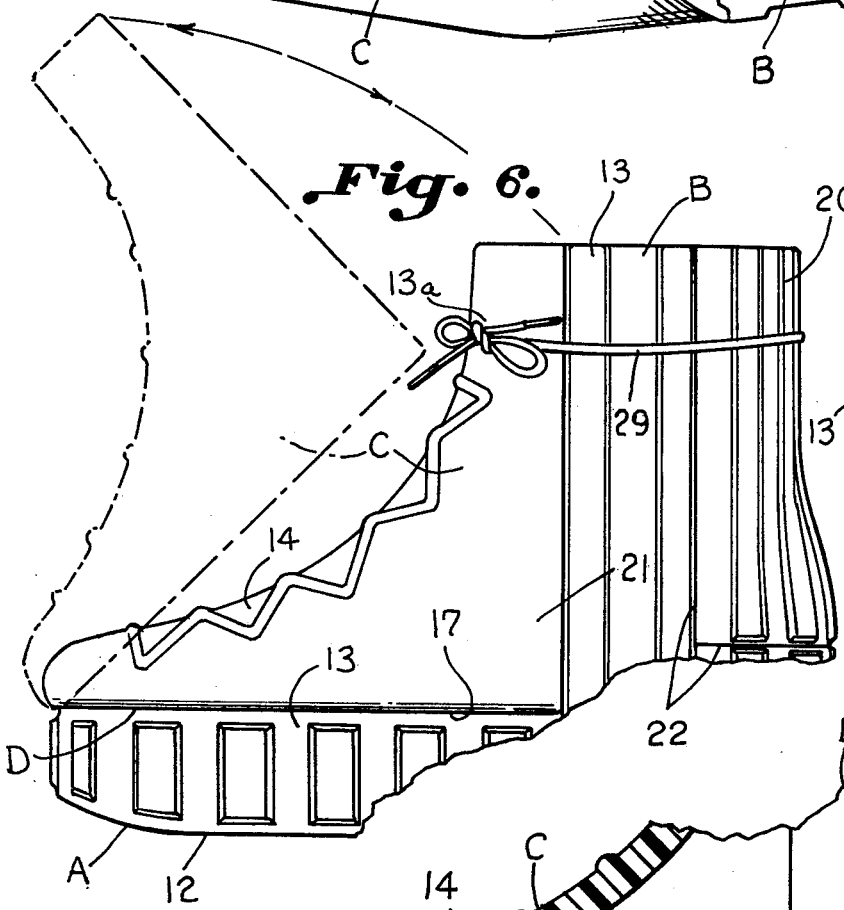
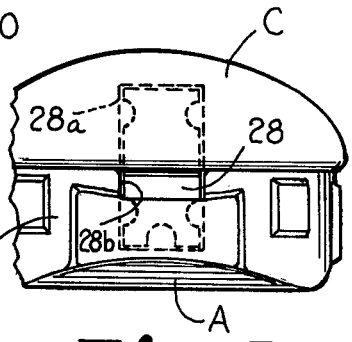
Fig. 7.
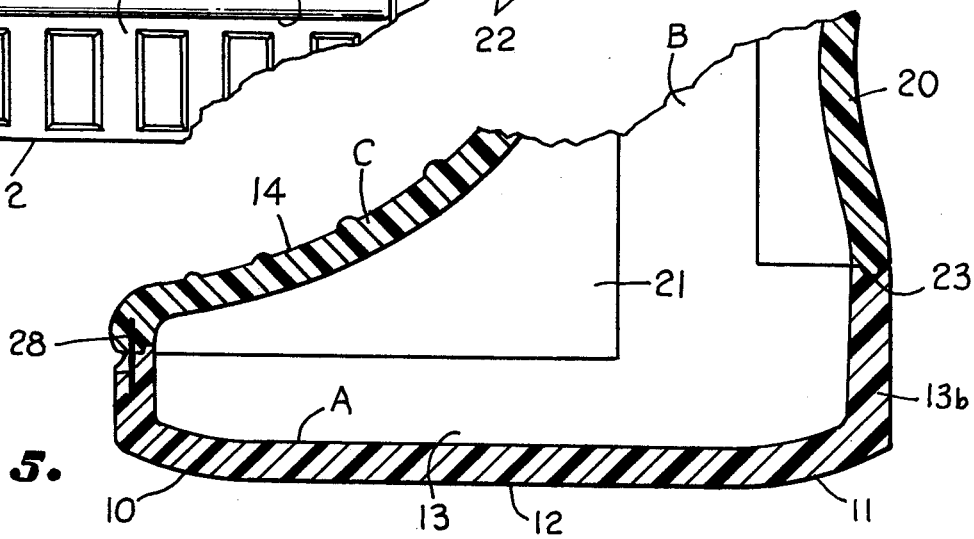
Fig. 5.

FOOT WARMER

BACKGROUND OF THE INVENTION

This is a continuation-in-part of co-pending application Ser. No. 648,115 filed Jan. 12, 1976, now abandoned.

Overshoes and the like have been commonly used to keep shoes, boots and the like dry, especially during inclement weather. Such foot covers have only limited insulating value as insulation is not a desirably feature except during very cold weather. The present invention, however, is directed to a foot warmer which may be worn during cold weather to keep the feet warm as well as dry. A foot cover has been suggested which is constructed of material having high insulating properties, as illustrated in United States Letters Pat. No. 3,373,512. A difficulty is presented, however, in placing such foot covers over shoes of the wearer. In the patent, the wearer's shoe is illustrated as requiring insertion through an enlarged opening at the top of the cover and a vertical slot is provided adjacent the heel to facilitate such insertion. Since the foot cover thus described is in the nature of a loafer, the tops are low and well below the ankle which does not admit of substantial innsulating value, or at least severely limits the value of the device for keeping the feet warm. While such may be of limited value for use with shoes, it would be of no practical value for use with boots.

Other patents illustrate footwear designed to receive the stocking foot of the wearer for conventional purposes. For example, United States Letters Pat. No. 3,792,537 illustrates a ski boot having a symmetrical outer member carrying a supporting shell pivoted at its lower end and closable simultaneously by closing a pivoted front cover. United States Letters Pat. No. 1,216,579 illustrates a boot for conventional wear having a rear panel with pivot point adjacent the sole. United States Letters Pat. No. 3,820,256 illustrates a ski boot having a front closure member pivotally attached intermediate the instep. No prior patent discloses an insulating foam foot warmer extending at least as far up as the area of the ankle capable of conveniently receiving the shoe-clad foot of the wearer.

Accordingly, it is an important object of this invention to provide an effective foot warmer which may be applied as overboots or other foot covering of hunters when on a stand or in a blind during severe weather.

Another important object of the invention is to provide a foot warmer which may be easily put on overboots and other standard foot coverings and yet provide substantial insulating properties extending in the area of the ankle of the wearer.

Another object of the invention is to provide a foot warmer capable of ready use with standard footwear as worn by sports fans, heavy equipment operators, construction workers, military personnel and winter sports fans during very cold, wet weather and which will provide substantial insulation for the foot area while effectively excluding water.

While the foot warmer is not designed for walking, a suitable substantially water-proof plastic foam material may be selected having high insulating properties, being relatively stiff and yet possessing sufficient strength and flexibility to permit limited walking by the wearers as described above. The foot warmer may be readily molded in three parts.

SUMMARY OF THE INVENTION

It has been found that a foot warmer may be provided having a removable end panel permitting the leg of the wearer to be snugly received at the top so as to afford effective insulation for the entire foot area and yet permit the foot warmer to be readily placed upon and worn over standard footwear.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 4 is a top plan view of the foot warmer illustrated in FIG. 1, FIG. 5 is a longitudinal sectional elevation taken on the line 5—5 in FIG. 4, FIG. 6 is a side elevation illustrating the removable front panel in broken lines in open position to permit the wearer to slide his foot therein through a rearwardly and inwardly tapering front opening provided by the panel, and FIG. 7 is a front elevation illustrating a hinge permitting removal of the front panel.

DESCRIPTION OF A PREFERRED EMBODIMENT

The drawings illustrate a foot warmer constructed essentially of a stiff insulating synthetic foam material for receiving a wearer's show, boot, and the like. A unitary sole A has a toe portion tapering inwardly toward the front, a heel portion tapering inwardly toward the rear, and upwardly extending marginal sides carried integrally therewith. An instep and toe cover bridges the sides adjacent a front portion thereof extending across the toe portion. The sides and cover define an opening at a top portion snugly receiving a leg of the wearer at least up to the ankle therein. The sides include longitudinal intermediate members B tapering inwardly toward the rear, and a removable front panel C including said instep and toe cover extending transversely of the sole bridging the intermediate members providing an open end tapering inwardly toward the rear when the panel is removed, for admitting the shoe, boot, and the like, by movement thereof between the sides longitudinally of the sole. Means D are provided for fastening the removable front panel in position bridging the intermediate members. The fastening means D include complimentary end portions on the removable panel and on the intermediate members for engagement in opposed relation.

The drawings illustrate a unitary sole A which has a toe portion 10 and a heel portion 11 and a bottom which preferably tapers upwardly towards the ends of the sole. The bottom may be covered as by suitable latex or other rubbery film as illustrated at 12. This cover provides additional insulating properties and, more importantly, traction when walking. If desired, the bottom of the sole may simply be textured in some other manner to provide traction with the walking surface in order to prevent slipping of the wearer, especially as on an icy surface. It will be noted that upwardly extending marginal sides 13 are carried by the sole integrally therewith following the marginal contour thereof and extend upwardly therefrom about the entire marginal portion of the sole. An instep and toe cover 14 extends upwardly integrally jointed with side portions 13*a* which cover the front portion of the leg of the wearer, illustrated as extending above the ankle.

Figure 1:
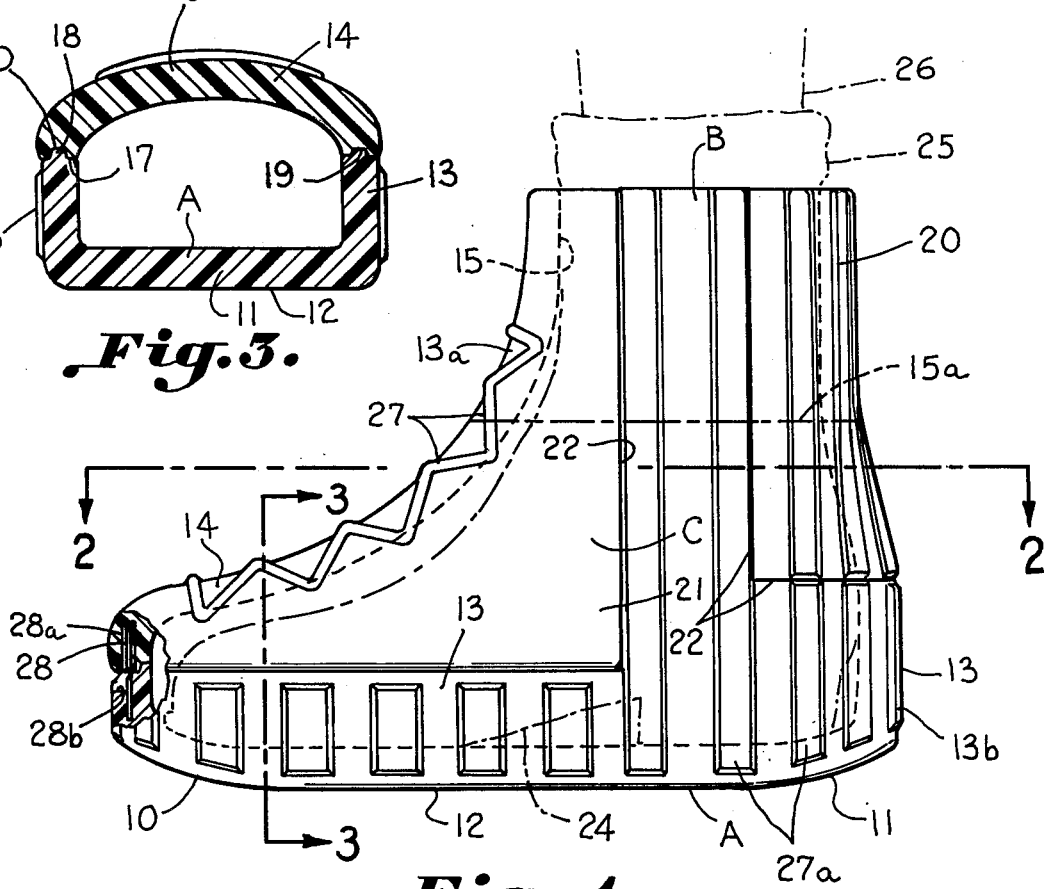
FIG. 1 is a side elevation illustrating a foot-warmer constructed in accordance with the present invention on the foot of a wearer.

Thus, the sides define an opening 15 at a top portion for snugly receiving the leg of a wearer therein. The opening 15 is sufficiently large to provide adequate clearance for the upper portion of a boot and the like so as not to be in direct contact therewith so as to be damaged by engagement therewith during walking. The leg and upper portion of a boot is, however, received sufficiently closely so that the insulating properties of the foot warmer portion may keep the entire foot of the wearer in insulating relation. In FIG. 1, the line 15a designates a cut-off point for a foot warmer which has a lower top extending to the ankle area as may be worn with lower top boots or shoes. If desired, a sealing strip 15*b*, which may be sponge rubber, may be secured as by adhesive 15*c* adjacent the open top to encircle the leg to provide further insulation.

Figure 2:
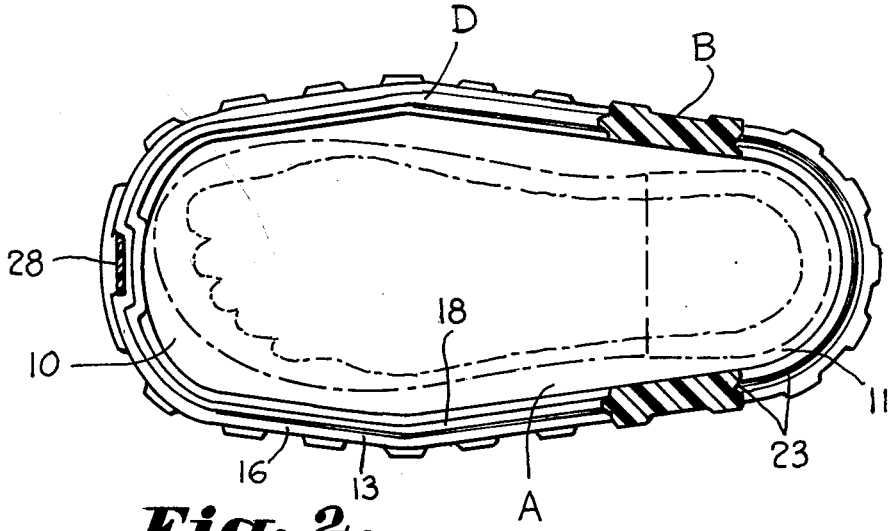
FIG. 2 is a sectional plan view taken on the line 2—2 in FIG. 1 with the displaceable front end panel and rear panel omitted.

The intermediate side members B are included in sides 13 and are illustrated as extending upwardly from the sole in FIG. 2 and toward the top as illustrated in FIG. 4. The intermediate members taper inwardly toward the rear. The sides include a removable front panel C which extends across the sole and bridges the intermediate members providing an opening when removed for insertion of the shoe-clad foot. If desired, the device hereof may be worn without other footwear although it is primarily adapted to be worn over shoes, boots, and the like.

Figure 3:
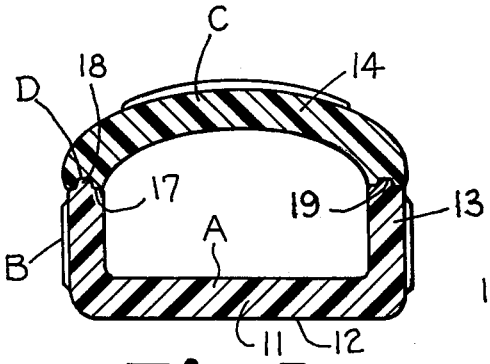
FIG. 3 is a transverse sectional elevation taken on the line 3—3 in FIG. 1.

The fastening means D is illustrated in FIGS. 2, 3 and 6 as including end portions having a free edge 16 complimentary to end portions 17 carried by the removable panel C. The end portion 16 has a rib 18 received within a groove 19 carried by the end portion 17. Thus, the fastening means D may include interfitting members or, in the alternative, may simply be flat abutting end portions.

The foot warmer is illustrated as having been molded, preferably from polystyrene, in three parts to facilitate molding in the desired shape with easy removal from the mold and minimized parts, and include the integral sole A and upstanding sides 13, the instep cover 14, front side portion 13*a*, and a rear panel portion 20. Preferably, the parts other than the panel are glued together as at 22 and are provided with interengaging portions 23, as illustrated in FIG. 2 for facilitating the joining of these elements.

As illustrated in FIG. 1, the boot or other foot covering is illustrated at 24 and the sock 25 and leg 26 of the wearer extend upwardly through the opening 15 provided at the top of the foot warmer. Molded strings or laces 27 are illustrated as being provided in the front panel and side portions for decorative effect, as well as reinforcement. It will be noted that spaced, vertical ribs 27*a* have been provided for reinforcement.

FIG. 6 further illustrates the invention wherein side portions 13*a* form the front panel C, together with the instep portion 14. These front removable panels C may be pivoted about a transverse horizontal axis by means of a suitable plastic hinge 28 or other hinge member molded or glued in the plastic. The hinge 28 may consist of a piece of textile fabric which may be fastened at the very front of the foot warmer to the instep portion 14 and the sides 13 as by gluing to provide a transverse horizontal pivot. Preferably, the hinge is plastic as illustrated at 28 in FIG. 7 and is carried in opposed cavities 28*a* and 28*b* for receiving same. The hinge 28 forms a part of the fastening means D for securing the panel C in position. A shoe string 29 may be utilized to supplement the attachment afforded by the interlocking rib and groove arrangement described above. If desired, the rib may be omitted, but it is important that the edges be complimentary to facilitate fastening and insulating properties. The rib may extend upwardly to provide a snap lock extending entirely about abutting edge of the panel C. The rear panel 20 may be glued into place since access to the foot warmer is provided through an opening afforded by the panel C when removed. In lieu of the shoe string, any other supplementary fastening means may be employed such as a strap (not shown) fixed on one end to the upper portion of the intermediate members B, passing over the pannel C and provided with Velcro fastening means on the intermediate opposite member B.

When the foot is being placed within the foot warmer illustrated, the panel C may be removed and the foot placed therein as when darning a slipper and the like. In FIGS. 1 and 5, it will be noted that a side wall 13*b* extends upwardly and that the panel 20 may be slid vertically and glued into position thereon. The wall 13*b* provides a means to prevent water from flowing in as might occur when walking through a shallow puddle. It will be noted that the wall 13*b* forms part of the vertical side portions that extend entirely about the sole. In addition to its water-proofing function, the vertical side portions afford reinforcement for the stiff sole 10 which, when flexed during walking, might otherwise break. The removable front panel C includes an extension 21 having a juncture with the sides and with the intermediate members at substantially a right angle. This construction facilitates fastening and provides reinforcement against breaking of the front panel at its intermediate area of maximum vulnerability.

When putting on the foot warmer, the panel C is removed to provide an opening for entry by the foot. The panel may then be firmly seated by pivoting and snapping or otherwise securing same into position. Effective insulation is then provided for the foot. If desired, the foot warmer may be constructed from colored plastic and since it may be molded in three parts, a variety of sizes and color combinations are possible as desired.

While a preferred embodiment of the invention has been described using specific terms, such description is for illustrative purposes only, and it is to be understood that changes and variations may be made without departing from the spirit or scope of the following claims.

What is claimed is:

1. A foot warmer constructed essentially of a stiff water-proof insulating synthetic foam material for receiving a wearer's shoe, boot and the like, comprising:

a unitary sole having a toe portion tapering inwardly toward the front and a heel portion tapering inwardly toward the rear;

vertically extending marginal sides integral with said sole;

an instep and toe cover bridging said sides adjacent a front portion thereof extending across said toe portion;

said sides and cover defining an opening at a top portion snugly receiving a leg of the wearer therein;

said sides including longitudinal intermediate members tapering inwardly toward the rear;

a removable front panel including said instep and toe cover extending transversely of said sole bridging said intermediate members extending entirely thereacross providing an open end tapering inwardly toward the rear, when said panel is removed for admitting said foot by movement thereof between said sides longitudinally of said sole;

a rear panel bridging said intermediate members and extending upwardly from said heel portion;

means fastening said removable front panel in position bridging said intermediate members; and said fastening means including complimentary end portions on said removable front panel and said intermediate members for engagement is opposed relation.

2. The structure set forth in claim 1 wherein said insulating synthetic foam material is molded polystyrene.

3. The structure set forth in claim 1 including a hinge connecting said cover to said toe portion and wherein said rear panel is a separate member fastened in bridging position.

4. The structure set forth in claim 1 wherein said removable front panel includes an extension of said sides having a juncture therewith and with said intermediate members at substantially a right angle.

5. The structure set forth in claim 3 including opposed cavities in said toe and in said removable front panel adjacent the forwardmost portion thereof, and a vertical hinge member secured on opposite ends in respective cavities providing a transverse horizontal pivot.

6. The structure set forth in claim 5 wherein said complimentary end portions include interfitting members carried by said removable front panel and said intermediate members.

7. A foot warmer constructed essentially of a stiff water-proof insulating synthetic foam material for receiving a wearer's shoe, boot and the like, comprising:

a unitary sole having a toe portion and a heel portion;

vertically extending marginal sides integral with said sole;

an instep and toe cover bridging said sides adjacent a front portion thereof extending across said toe portion;

said sides and cover defining an opening at a top portion snugly receiving a leg of the wearer at least as far up as the ankle therein;

said sides including longitudinal intermediate members;

a removable front panel including said instep and toe cover extending transversely of said sole bridging said intermediate members extending entirely therecross providing an open end when said panel is removed for admitting said foot by movement thereof between said sides longitudinally of said sole;

a rear panel bridging said intermediate members and extending upwardly from said heel portion;

means fastening said removable front panel in position bridging said intermediate members;

said fastening means including complimentary end portions on said removable front panel and said intermediate members for engagement in opposed relation; and a hinge connecting said cover to said toe portion.

* * * * *